US012752208B2

(12) United States Patent
Puotkalis

(10) Patent No.: US 12,752,208 B2
(45) Date of Patent: Oct. 6, 2026

(54) BUILDING BLOCK FOR A CONSTRUCTION TOY SET

(71) Applicant: DOUBLEEAGLE INDUSTRY (CHINA) LIMITED, Hong Kong (CN)

(72) Inventor: Martynas Puotkalis, Vilnius (LT)

(73) Assignee: DOUBLEEAGLE INDUSTRY (CHINA) LIMITED, Hong Kong (HK)

( * ) Notice: Subject to any disclaimer, the term of this patent is extended or adjusted under 35 U.S.C. 154(b) by 237 days.

(21) Appl. No.: 18/676,652

(22) Filed: May 29, 2024

(65) Prior Publication Data

US 2024/0399269 A1 Dec. 5, 2024

(30) Foreign Application Priority Data

May 29, 2023 (DE) ..... 10 2023 114 039.6

(51) Int. Cl.
*A63H 3/06* (2006.01)
*A63H 33/06* (2006.01)

(52) U.S. Cl.
CPC ..... *A63H 33/06* (2013.01)

(58) Field of Classification Search
CPC ..... A63H 33/04; A63H 33/06; A63H 33/067
See application file for complete search history.

(56) References Cited

U.S. PATENT DOCUMENTS 2,683,329 A * 7/1954 Kobler ..... F16B 7/048 446/124
5,049,104 A * 9/1991 Olsen ..... A63H 33/042 446/104
6,325,694 B1 * 12/2001 Clever ..... A63H 33/082 446/104
7,588,476 B2 * 9/2009 Hammond ..... A63H 33/086 446/104
10,493,371 B2 * 12/2019 Cochella ..... A63H 33/101
11,491,413 B2 * 11/2022 Anderson ..... A63H 33/086
(Continued)

FOREIGN PATENT DOCUMENTS

CN 106823411 A * 6/2017 ..... A63H 33/12
WO WO-2005005008 A1 * 1/2005 ..... A63H 33/08

*Primary Examiner* — Kurt Fernstrom
(74) *Attorney, Agent, or Firm* — IPro, PLLC

(57) ABSTRACT

The invention relates to a building block (2) for a construction toy set, comprising a base body (12) extending in a longitudinal direction (6), in a transverse direction (8) transverse to the longitudinal direction (6) and in a vertical direction (10) transverse to the longitudinal direction (6) and transverse to the transverse direction (8), which is penetrated in the vertical direction (10) by a passage opening (14) and from which a first axle element (16) projects in the longitudinal direction (6) and a second axle element (18) projects in the transverse direction (8), characterized in that the base body (12) is formed from two subcomponents (4) which each hold an axle element (16, 18), wherein each subcomponent (4) comprises a connecting surface (16) for abutment against the connecting surface (16) of the corresponding other subcomponent (4), and wherein a male positive-locking element (18) projects from the connecting surface (16) of one subcomponent (4) and, in the assembled state of the base body (12), is inserted into a corresponding female positive-locking element (20) which is molded into the connecting surface (16) of the other subcomponent (4).

11 Claims, 2 Drawing Sheets

(56) References Cited

U.S. PATENT DOCUMENTS

| | | | | |
|---|---|---|---|---|
| 2016/0121235 | A1* | 5/2016 | Lin | A63H 3/46<br>446/124 |
| 2016/0123360 | A1* | 5/2016 | Lin | F16B 7/04<br>403/122 |
| 2024/0216827 | A1* | 7/2024 | Choi | A63H 33/042 |

* cited by examiner

BUILDING BLOCK FOR A CONSTRUCTION TOY SET

TECHNICAL FIELD

The present invention relates to a building block for a construction toy set pursuant to the preamble of claim 1.

BACKGROUND

At the time of application, such a building block is available at the URL https://www.bricklink.com/v2/catalog/catalogitem.page?P=10197, and is used to build mechanisms that distribute movement across several axles. The building block is very useful in technical building block models, such as robots or mechanical vehicles, and enables more complex and realistic movements.

SUMMARY

It is the object of the invention to improve the known building block.

The task is fulfilled by the characteristics of the independent claim. Preferred embodiments are the subject matter of the dependent claims.

According to one aspect of the invention, a building block for a construction toy set comprises a base body extending in a longitudinal direction, in a transverse direction transverse to the longitudinal direction and in a vertical direction transverse to the longitudinal direction and transverse to the transverse direction, which is penetrated in the vertical direction by a passage opening and from which a first axle element projects in the longitudinal direction and a second axle element projects in the transverse direction, wherein the base body is formed from two subcomponents which each hold an axle element, wherein each subcomponent comprises a connecting surface for abutment against the connecting surface of the corresponding other subcomponent, and wherein a male positive-locking element projects from the connecting surface of one subcomponent and, in the assembled state of the base body, is inserted into a corresponding female positive-locking element which is molded into the connecting surface of the other subcomponent.

The specified building block is based on the consideration that the known building block is comparatively stiff, but often has to absorb kinetic energy when implementing complex and realistic movements in building block models. Due to the required strength, however, such building blocks are made of a comparatively stiff material such as acrylonitrile-butadiene-styrene copolymer, ABS for short, which is valued as a material for construction toys due to its high strength, its good surface quality and its ease of processing. The rigidity of ABS in particular is one of the reasons why it is often used for construction toys, as the building blocks need to retain their shape in order to be connected effectively and form stable structures.

However, this rigidity reduces the kinetic energy that can be absorbed because the material cannot yield elastically. The production from a different material is generally out of the question because this is uneconomical in terms of manufacturing technology. This is where the invention comes in with the suggestion of realizing the building block in a multipart design. The multipart design introduces tolerances and other margins into the construction, which can be used to absorb kinetic energy and prevent the building block from being damaged.

In an embodiment of the specified building block, the connecting surface of each subcomponent extends over a step with an upper side delimiting the step in or against the vertical direction and an abutment surface delimiting the step at right angles to the upper side. This step increases a friction surface between the two subcomponents, which in turn can absorb kinetic energy.

In a further embodiment of the specified building block, a wall is placed on the step of each subcomponent, against which the step of the respective other subcomponent rests at right angles to the vertical direction. The wall can hide the step to the outside, so that the building block appears more monolithic.

In a particular embodiment of the specified building block, the male positive-locking element is designed as a projection protruding from the step of each subcomponent at right angles to the vertical direction, which engages in a corresponding recess in the wall of each subcomponent. The resulting positive fit can be easily implemented as a slight interference fit and thus increase the stability of the entire building block.

In a preferred embodiment of the specified building block, the recess in the wall of each subcomponent is bounded by the wall in or against the longitudinal direction and in or against the transverse direction. In this way, a corner is created in each subcomponent, which stabilizes the other subcomponent in the longitudinal direction and in the transverse direction.

In a particularly preferred embodiment of the specified building block, the recess in the wall of each subcomponent is rounded at a transition between the transverse direction and the longitudinal direction. This rounding can be used to compensate for tolerances in order to assemble the two subcomponents precisely to form the specified building block.

In another embodiment of the specified building block, the projection of each subcomponent has a projection height of 50% to 95%, preferably of 60% to 80%, particularly preferably of 66% of a height of the shoulder, when viewed in the vertical direction. Within these ranges, a particularly high stability for the building block is achieved on the one hand, but the aim of creating sufficient freedom of movement is maintained.

In yet another embodiment of the specified building block, the wall of each subcomponent has a recess into which the wall of the corresponding other subcomponent engages. This recess can be used to increase the positioning accuracy of the two subcomponents relative to each other.

In a further embodiment of the specified building block, the wall of each subcomponent has a staircase-shaped profile in some areas, whereby a further increase in the positioning accuracy of the two subcomponents relative to each other is achieved.

In an additional embodiment, the two subcomponents are of identical design, which means that the specified building block can be master molded with a single master mold.

BRIEF DESCRIPTION OF FIGURES

The above-described properties, features and advantages of this invention, as well as the manner in which they are achieved, will become clearer in connection with the following description of the embodiments, which are explained in more detail in connection with the drawing, in which.

In the figures, the same technical elements are provided with the same reference signs, and are only described once. The figures are purely schematic and, in particular, do not reflect the actual geometric proportions.

DETAILED DESCRIPTION

Figure 1:
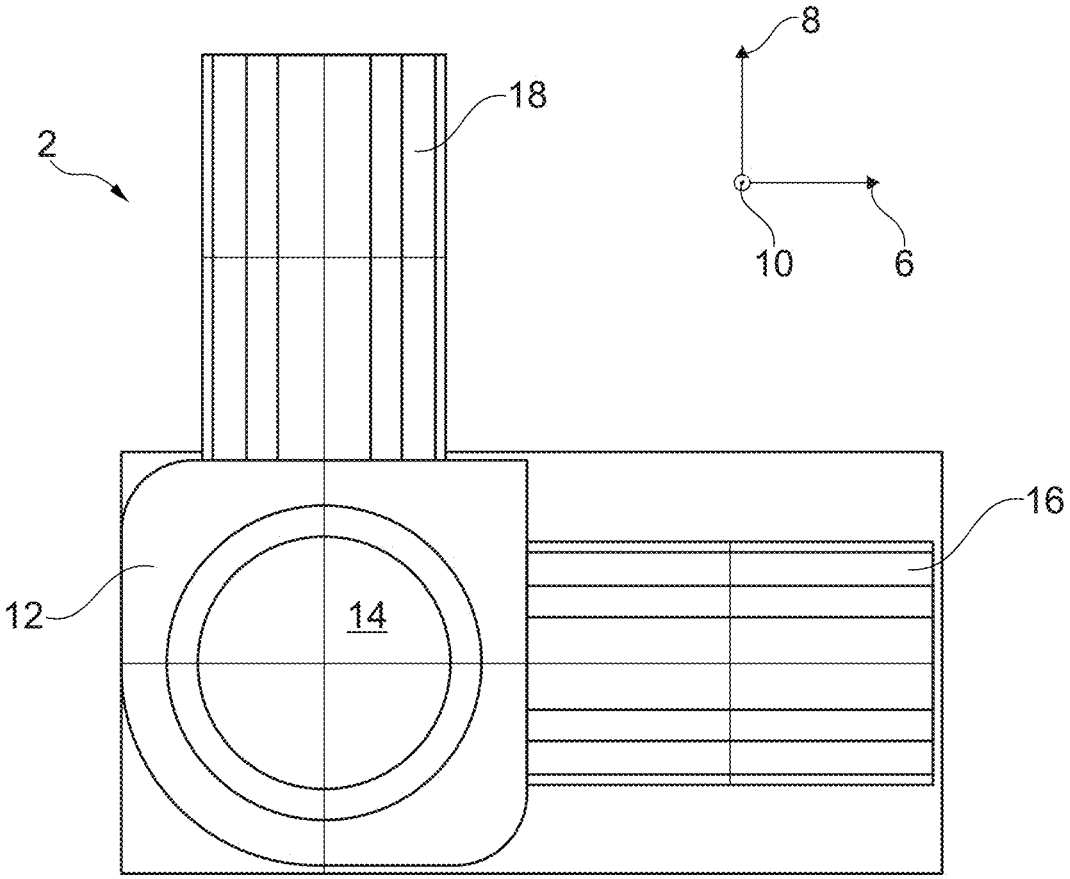
FIG. 1 is a plan view of a building block for a construction toy set.
Figure 2:
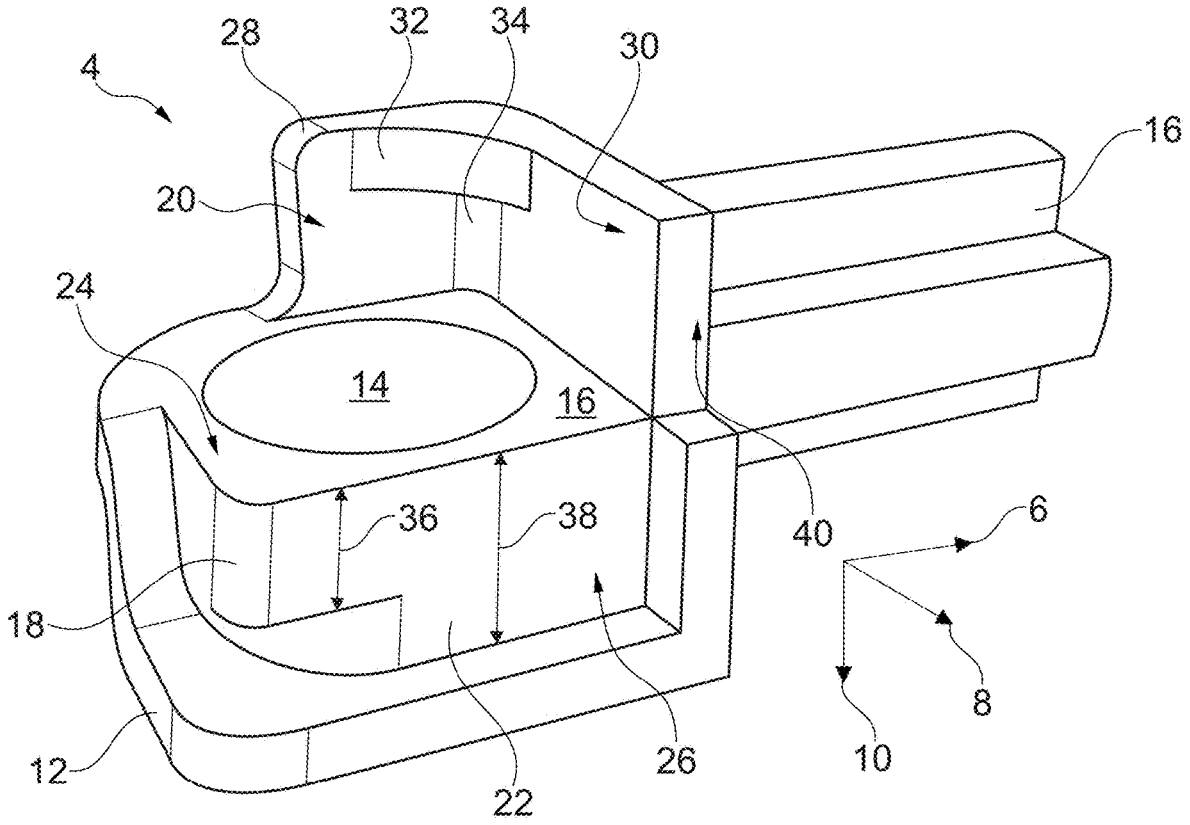
FIG. 2 is a perspective view of a subcomponent of the building block of FIG. 1.

Reference is made to FIGS. 1 and 2, which show a building block 2 for a construction toy set not shown further in a plan view and a subcomponent 4 of the building block 2 in a perspective view.

The building block 2 comprises a base body 12 extending in a longitudinal direction 6, in a transverse direction 8 transverse to the longitudinal direction 6, and in a vertical direction 10 transverse to the longitudinal direction 6 and transverse to the transverse direction 8. The base body 12 is penetrated by a passage opening 14 in the vertical direction 10. A first axle element 16 projects from it in the longitudinal direction 6 and a second axle element 18 projects from it in the transverse direction 8.

In the present embodiment, the two axle elements 16, 18 are designed as cross axle elements which allow them to be inserted into a correspondingly designed cross opening of another building block. This results in a fixed bearing in the circumferential direction around the respective axle element. However, the axle elements are not limited to this cross shape and to this function. For example, axle elements can also be used that allow a movement around the respective axle element.

According to the invention, the base body 12 is formed from two subcomponents 4, each of which holds an axle element. In the present embodiment, these two subcomponents 4 are of identical design, which is why only one of the two subcomponents 4 is shown in FIG. 2.

Each subcomponent 4 comprises a connecting surface 16 for contact with the connecting surface 16 of the corresponding other subcomponent 4. The connecting surfaces 16 of the subcomponents 4 thus lie against each other in the assembled state. A male positive-locking element 18 projects from the connecting surface of each subcomponent and, in the assembled state of the base body, is inserted into a corresponding female positive-locking element 20, which is molded into the connecting surface 16 of each subcomponent 4. In this way, two independent positive fits are created, which are arranged radially outside the passage opening 14 and thus increase the stability of the building block. However, two positive fits can only be created if both subcomponents have the same design. Without this prerequisite, the building block 2 can also be realized with a single positive fit between the subcomponents 4.

In each subcomponent 4, the connecting surfaces 16 each extend over a step 22, which in FIG. 2 is bounded by an upper surface 24 against the vertical direction 10 and by an abutment surface 26 at right angles to the vertical direction 10. Furthermore, a wall 28 is placed on the step 22 of each subcomponent 4, against which the step 22 of the respective other subcomponent 4 can be placed at right angles to the vertical direction 10. The corresponding contact surface is provided with the reference sign 30 in FIG. 2.

The male positive-locking element 18 projects from the step 22 of each subcomponent 4 at right angles to the vertical direction 10 and is formed as a corresponding projection. This projection can thus be inserted into the corresponding recess 20 in the wall 28 of the corresponding other subcomponent 4.

The recess 20 of the subcomponent shown in FIG. 2 is bounded by the wall in the longitudinal direction 6 and against the transverse direction 8 and is thus angular in shape. In the opposite direction to the vertical direction 10, a further wall section 32 delimits the recess 20 and thus also defines the positive fit in the vertical direction 10. The recess 20 in the wall 28 of each subcomponent 4 is rounded at a transition 34 between the transverse direction 8 and the longitudinal direction 6.

The projection 18 of each subcomponent 4 has a projection height 36 when viewed in the vertical direction 10, while the shoulder 22 has a shoulder height 38. The projection height 36 should be selected between 50% and 95%, preferably from 60% to 80% of the shoulder height 38. In the present embodiment, the projection height 36 is 66% of the shoulder height 38.

Furthermore, the wall 28 of each subcomponent 4 has a recess 40 into which the wall 28 of the corresponding other subcomponent 4 can engage.

To assemble the building block, the upper sides 24 of the shoulders 22 of the two subcomponents 4 are placed on top of each other in such a way that the respective projections 18 are directed towards the recesses 20 of the respective other subcomponent 4. The two subcomponents 4 are then moved towards each other in the longitudinal direction 6 and in the transverse direction 8 so that the projections 18 are inserted into the recesses 20. The upper sides 24 ensure that the two subcomponents 4 are guided so that the projections 18 can be inserted very easily into the recesses 20.

In the assembled state, when the projections 18 engage in the recesses 20, the positive fit secures the building block 2 against loosening both in and against the vertical direction 10. If a shaft or a similar component is also inserted into the passage opening 14, the building block 2 is also secured against unintentional loosening transverse to the vertical direction.

The positive fit between the projections 18 and the recesses 20 can be extended by a frictional connection. In this case, the projection height 36 should be slightly greater than a corresponding height of the recess 20, which is not referenced further. However, care must be taken to ensure that the difference in height is only very small and with low tolerances, so that the projections 18 can still be pushed into the recesses 20, even if with some effort.

The invention claimed is:

1. Building block for a construction toy set, comprising a base body extending in a longitudinal direction, in a transverse direction transverse to the longitudinal direction and in a vertical direction transverse to the longitudinal direction and transverse to the transverse direction, which is penetrated in the vertical direction by a passage opening and from which a first axle element projects in the longitudinal direction and a second axle element projects in the transverse direction, characterized in that the base body is formed from two subcomponents which each hold an axle element, wherein each subcomponent comprises a connecting surface for abutment against the connecting surface of the corresponding other subcomponent, and wherein a male positive-locking element projects from the connecting surface of one subcomponent and, in the assembled state of the base body, is inserted into a corresponding female positive-locking element which is molded into the connecting surface of the other subcomponent;

wherein the connecting surface of each subcomponent extends over a step with an upper side delimiting the step in or against the vertical direction and an abutment surface delimiting the step at right angles to the upper side.

2. Building block according to claim 1, wherein a wall is placed on the step of each subcomponent, against which wall the step of the respective other subcomponent rests at right angles to the vertical direction.

3. Building block according to claim 2, wherein the male positive-locking element is designed as a projection protruding from the step of each subcomponent at right angles to the vertical direction, which engages in a corresponding recess in the wall of each subcomponent.

4. Building block according to claim 3, wherein the recess in the wall of each subcomponent is bounded by the wall in or against the longitudinal direction and in or against the transverse direction.

5. Building block according to claim 4, wherein the recess in the wall of each subcomponent is rounded at a transition between the transverse direction and the longitudinal direction.

6. Building block according to claim 3, wherein the projection of each subcomponent has a projection height of 50% to 95% of a height of the shoulder, when viewed in the vertical direction.

7. Building block according to claim 3, wherein the projection of each subcomponent has a projection height of 60% to 80% of a height of the shoulder, when viewed in the vertical direction.

8. Building block according to claim 3, wherein the projection of each subcomponent has a projection height of 66% of a height of the shoulder, when viewed in the vertical direction.

9. Building block according to claim 2, wherein the wall of each subcomponent has a recess into which the wall of the corresponding other subcomponent engages.

10. Building block according to claim 2, wherein in each subcomponent the wall has a staircase-shaped profile in some areas.

11. Building block according to claim 1, wherein the two subcomponents are of identical design.

* * * * *